US008439723B2

(12) United States Patent
Marks et al.

(10) Patent No.: US 8,439,723 B2
(45) Date of Patent: May 14, 2013

(54) CHEMICAL MECHANICAL POLISHER WITH HEATER AND METHOD

(75) Inventors: Robert A. Marks, San Jose, CA (US); Christopher Heung-Gyun Lee, San Jose, CA (US); Garlen C. Leung, San Jose, CA (US); Gregory E. Menk, Pleasanton, CA (US); Jie Diao, Fremont, CA (US); Erik S. Rondum, San Ramon, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1008 days.

(21) Appl. No.: 12/189,641

(22) Filed: Aug. 11, 2008

(65) Prior Publication Data

US 2010/0035515 A1 Feb. 11, 2010

(51) Int. Cl.
*B24B 49/14* (2006.01)

(52) U.S. Cl.
USPC ..... 451/7; 451/53

(58) Field of Classification Search ..... 451/5, 7, 451/53, 287, 288, 289, 168, 173, 21
See application file for complete search history.

(56) References Cited

U.S. PATENT DOCUMENTS

| | | | | |
|---|---|---|---|---|
| 4,991,529 | A | 2/1991 | McKune et al. | |
| 5,709,593 | A | 1/1998 | Guthrie et al. | |
| 5,775,980 | A * | 7/1998 | Sasaki et al. | 451/285 |
| 5,957,750 | A * | 9/1999 | Brunelli | 451/7 |
| 5,964,413 | A | 10/1999 | Mok | |
| 6,053,801 | A | 4/2000 | Pinson et al. | |
| 6,098,901 | A | 8/2000 | Mok | |
| 6,139,406 | A | 10/2000 | Kennedy et al. | |
| 6,152,806 | A | 11/2000 | Nystrom | |
| 6,179,690 | B1 | 1/2001 | Talieh | |
| 6,196,900 | B1 | 3/2001 | Zhang et al. | |
| 6,206,760 | B1 | 3/2001 | Chang et al. | |
| 6,220,941 | B1 | 4/2001 | Fishkin et al. | |
| 6,224,461 | B1 * | 5/2001 | Boehm et al. | 451/7 |
| 6,227,939 | B1 | 5/2001 | Monroe | |
| 6,251,001 | B1 | 6/2001 | Pinson et al. | |
| 6,257,954 | B1 | 7/2001 | Ng et al. | |
| 6,280,299 | B1 | 8/2001 | Kennedy et al. | |
| 6,283,840 | B1 | 9/2001 | Huey | |
| 6,284,092 | B1 | 9/2001 | Manfredi | |
| 6,315,635 | B1 * | 11/2001 | Lin | 451/7 |
| 6,336,850 | B1 | 1/2002 | Wada et al. | |
| 6,347,650 | B1 | 2/2002 | Affleck et al. | |

(Continued)

FOREIGN PATENT DOCUMENTS

| | | |
|---|---|---|
| JP | 11277413 | 10/1999 |
| JP | 2001062706 | 3/2001 |

(Continued)

OTHER PUBLICATIONS

U.S. Appl. No. 09/490,519, filed Jan. 25, 2000, Monroe, Michael.

*Primary Examiner* — Robert Rose
(74) *Attorney, Agent, or Firm* — Ashok K. Janah; Janah & Associates, P.C.

(57) ABSTRACT

A chemical mechanical apparatus comprises a polishing platen, a roller pad assembly capable of advancing a polishing pad across the platen, a substrate carrier to press a substrate against the polishing pad, and a heater to heat the substrate to a temperature sufficiently high to provide a rate of removal of material from the substrate that compensates for the wear of the polishing pad.

18 Claims, 4 Drawing Sheets

U.S. PATENT DOCUMENTS

| | | | | |
|---|---|---|---|---|
| 6,398,627 | B1 | 6/2002 | Chiou et al. | |
| 6,482,290 | B1 | 11/2002 | Cheng et al. | |
| 6,623,341 | B2 | 9/2003 | Tolles | |
| 6,626,744 | B1 | 9/2003 | White et al. | |
| 6,682,404 | B2 | 1/2004 | Brunelli | |
| 6,685,796 | B1 | 2/2004 | Lin et al. | |
| 6,699,356 | B2 | 3/2004 | Bachrach et al. | |
| 6,824,455 | B2 | 11/2004 | Osterheld et al. | |
| 6,921,317 | B2 | 7/2005 | Wood et al. | |
| 6,935,926 | B2 | 8/2005 | Brunelli | |
| 6,945,857 | B1 | 9/2005 | Doan et al. | |
| 6,953,750 | B1 * | 10/2005 | Wu et al. | 438/691 |
| 7,014,538 | B2 | 3/2006 | Tietz et al. | |
| 7,037,854 | B2 | 5/2006 | Bachrach et al. | |
| 7,048,607 | B1 | 5/2006 | Wu et al. | |
| 7,052,374 | B1 | 5/2006 | Lu et al. | |
| 7,066,795 | B2 | 6/2006 | Balagani et al. | |
| 7,182,677 | B2 | 2/2007 | Donohue et al. | |
| 7,201,634 | B1 * | 4/2007 | Naujok et al. | 451/7 |
| 7,214,123 | B2 | 5/2007 | Han | |
| 7,238,084 | B2 | 7/2007 | Kim | |
| 7,335,088 | B1 | 2/2008 | Hwang et al. | |
| 2002/0013124 | A1 | 1/2002 | Tsujimura et al. | |
| 2002/0086619 | A1 | 7/2002 | Tolles | |
| 2002/0090819 | A1 | 7/2002 | Xu et al. | |
| 2002/0164928 | A1 | 11/2002 | Tolles | |
| 2003/0008600 | A1 | 1/2003 | Ide | |
| 2003/0119427 | A1 | 6/2003 | Misra | |
| 2004/0029489 | A1 | 2/2004 | Tsujimura et al. | |
| 2006/0094338 | A1 | 5/2006 | Kim | |
| 2006/0201532 | A1 | 9/2006 | Shirazi | |
| 2007/0042680 | A1 | 2/2007 | Benvegnu et al. | |
| 2007/0117500 | A1 | 5/2007 | Bonner et al. | |

FOREIGN PATENT DOCUMENTS

| | | | |
|---|---|---|---|
| JP | 202018703 | | 1/2002 |
| JP | 2003257914 | | 9/2003 |
| KR | 3001896 | A | 1/2003 |
| KR | 3084477 | A | 11/2003 |
| KR | 4079486 | A | 6/2004 |
| TW | 0442360 | B | 6/2001 |
| TW | 0458849 | B | 10/2001 |
| WO | WO-9951398 | | 10/1999 |
| WO | WO 01/62437 | | 8/2001 |
| WO | WO-2007024807 | | 3/2007 |
| WO | WO-2009127932 | | 10/2009 |

* cited by examiner

CHEMICAL MECHANICAL POLISHER WITH HEATER AND METHOD

BACKGROUND

Embodiments of the present invention relate to a chemical mechanical polisher having a heater and related methods.

In the fabrication of integrated circuits, chemical-mechanical planarization (CMP) can be used to smoothen the surface of a substrate for subsequent processing. A typical CMP apparatus comprises a substrate carrier that oscillates and presses a substrate against a polishing pad to polish the substrate. Optionally, a polishing medium can be supplied to the pad, the polishing medium comprising, for example, a polishing liquid and abrasive particles. CMP can be used, for example, to planarize dielectric layers, deep or shallow trenches filled with polysilicon or silicon oxide, and metal-containing films. It is believed that CMP polishing typically occurs as a result of both chemical and mechanical effects with a chemically altered layer being repeatedly formed at, and polished away from, the surface of the substrate.

However, during the CMP process, the polishing pad gradually wears out over time as a number of substrates are polished. One type of polishing pad comprises a circular polishing disc containing small abrasive particles that mechanically abrade and polish the substrate. This polishing disc has a sticky back which adheres to the surface of a polishing platen. After some time, the polishing disc wears out, and is replaced. However, pad replacement can be time consuming because the worn out disc has to be peeled off the polishing platen, the adhesive residue cleaned, and a new disc installed.

Another polishing pad, the roller pad, comprises a polishing sheet that is rolled up in a cylinder to provide a continuous feed of polishing pad. The roller pad can be replaced without requiring peeling of the pad from the platen or cleaning adhesive from the platen. Further, since the roller pad has a total polishing surface that is many times larger than the disk pad, the roller pad generally does not require as frequent replacement as the disk pad. The roller polishing pad is stretched across a rectangular polishing platen and gradually advanced across the platen to provide the polishing surface for a substrate. The polishing sheet comprises a web of abrasive material that mechanically abrades the substrates. After a single or set number of substrates are processed, the roller pad is advanced an incremental amount to provide a portion of new and unused polishing surface to the substrate. As one example, after each substrate is processed, the roller pad can be advanced from 5 to 10 mm. After these incremental advances deplete the entire roll of polishing pad sheet, a new roll can be installed.

For the roller pad CMP system, in order to reduce costs associated with substrate polishing, it is desirable to reduce the incremental rate of advance of the polishing sheet to use a lesser amount of polishing sheet material to polish a batch of substrates. However, when the incremental advancing rate is reduced, the substrates take longer to polish and this increase in polishing time is not desirable. Also, in both types of polishing pads, the polishing rate obtainable with the pad surface decreases with use as polishing residue containing ground-off substrate material and broken slurry particles clog up the polishing surface of the pad. Other changes in the topographical nature of the polishing pad can also lead to a reduced removal rate. A glazed pad surface provides reduced polishing efficiency because the polishing pad becomes smooth and clogged with debris, or simply holds less polishing medium. This results in a longer polishing time per substrate and increased consumption of polishing medium. Further, as the polishing efficiency of the pad reduces, the polishing depth can also vary from one substrate to another in a batch. These variations in polishing time and polishing rate from one substrate to another, and the increased usage of polishing medium and pad, are undesirable.

SUMMARY

According to one embodiment, a chemical mechanical apparatus comprises a polishing platen and a roller pad assembly capable of advancing a polishing pad across the platen. A substrate carrier is provided to press a substrate against the polishing pad. A heater heats the substrate to a temperature sufficiently high to provide a rate of removal of material from the substrate that compensates for the wear of the polishing pad.

In another embodiment, a chemical mechanical polishing method comprises polishing a substrate on a polishing pad, and before, during or after polishing the substrate, advancing the polishing pad by a span comprising a length of polishing pad. The substrate is heated to a temperature sufficiently high to compensate for the wear of the polishing pad over time, thereby maintaining the polishing rate obtained for the substrate within a range.

DRAWINGS

These features, aspects and advantages of the present invention will become better understood with regard to the following description, appended claims, and accompanying drawings, which illustrate examples of the invention. However, it is to be understood that each of the features can be used in the invention in general, not merely in the context of the particular drawings, and the invention includes any combination of these features, where:

DESCRIPTION

Figure 1:
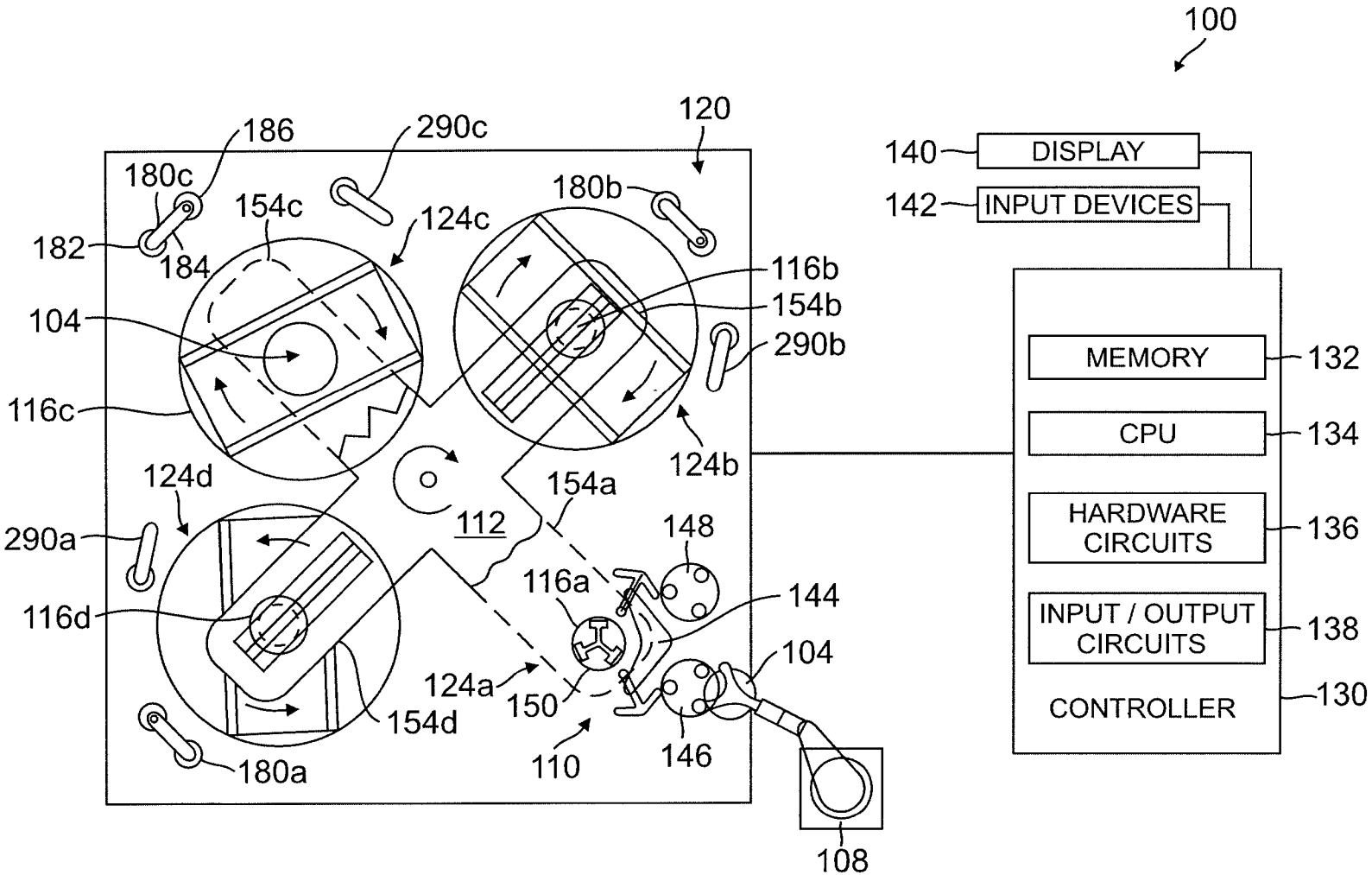
FIG. 1 is a schematic top view of a chemical mechanical polishing apparatus comprising a plurality of polisher stations that each have a roller pad.

An embodiment of a chemical mechanical polisher 100 suitable for polishing a surface of a substrate 104 comprising a semiconductor wafer, is shown in FIG. 1. The polisher 100 comprises, a loading robot 108, a substrate transfer station 110, a carousel 112 that supports one or more substrate carriers 116*a-d,* a tabletop 120 with a plurality of polisher stations 124*a-d,* and a controller 130 to control operation of the polisher 100. The polisher 100 can be a polishing system of the type known as a REFLEXION™ Chemical Mechanical Polisher system, or a MIRRA® Chemical Mechanical Polisher system, both manufactured by Applied Materials, Inc., Santa Clara, Calif. or other embodiments and types of CMP polishers. While a particular embodiment of a polisher 100 is shown to illustrate the present invention, it should not be used to limit the scope of the invention, and other embodiments can be used as would be apparent to one of ordinary skill in the art.

The controller 130 of the polisher 100 is provided to control components such as the loading robot 108, transfer station 110, and polisher stations 124*a-d*. The controller 130 is a programmable computer that can be used to calculate and measure polishing parameters and hold recipes, for at least one of the polisher stations 124*a-d*. The controller 130 can be one device or multiple devices that calculate and communicate with the polisher stations 124*a-d* to process a batch of substrates 104. The substrates 104 may include semiconductor wafers. To start polishing a substrate, the controller 130 controls the loading robot 108 to transfer a substrate 104 from a cassette containing a batch of substrates 104 to the transfer station 110 of the polisher 100, and upon completion of processing of the substrate 104, it is transferred back from the transfer station 104 to the cassette. The loading robot 108 is located on the periphery of the chemical mechanical polisher 100. An example of a loading robot 108 is a 4-Link robot, manufactured by Kensington Laboratories, Inc., Richmond, Calif.

The transfer station 110 generally includes a transfer robot 144, an input buffer station 146, an output buffer station 148 and a load cup assembly 150. The input buffer station 146 receives a substrate 104 from the loading robot 108. The transfer robot 144 moves the substrate 104 from the input buffer station 146 to the load cup assembly 150 where it may be transferred to a substrate carrier 116*a-d*. A suitable embodiment of a transfer station 110 is described in U.S. Pat. No. 6,156,124, issued Dec. 5, 2000, entitled "Wafer Transfer Station for a Chemical Mechanical Polisher".

The carousel 112 of the polisher 100 has a plurality of carousel arms 154*a-d* that each support a substrate carrier 116*a-d*, respectively. In FIG. 1, two of the carousel arms 154*a,c* are shown in phantom to show the underlying transfer station 110, and the substrate 104 held by the substrate carrier 116*c*. The carousel 112 rotates to move the substrate carriers 116*a-d* between polisher stations 124*a-d* and also from and back to the transfer station 110. An exemplary carousel is described in U.S. Pat. No. 5,804,507, issued on Sep. 8, 1998, and entitled "Radially oscillating carousel processing system for chemical mechanical polisher". Typically, a chemical mechanical polishing process is performed by rotating the carousel 112 to process a substrate 104 held in a particular substrate carrier 116 at a plurality of the polisher stations 124*a-d*. The substrate carriers 116*a-d* releasably hold substrates 104 with an adhesive, vacuum force, mechanical clamp, or other holding methods. The polisher stations 124*a-d* can include CMP stations, rinsing stations, cleaning stations, and other substrate processing stations. Each of the polisher stations 124*a-d* can operate independently to allow different processing tasks to be performed on different substrates 104 at the same time.

Figure 2A:
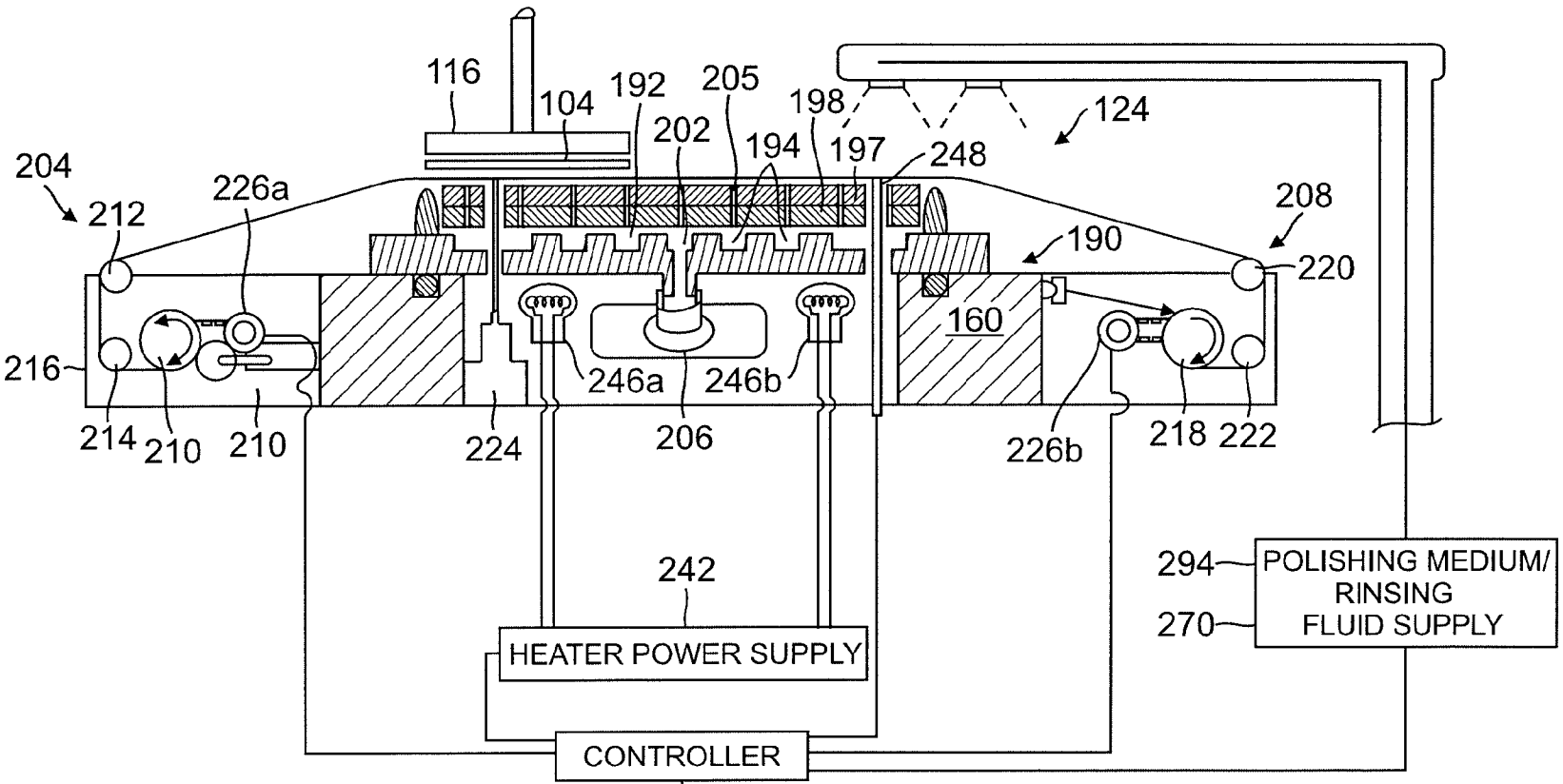
FIG. 2A is a schematic side view of a polisher station comprising a roller pad with a platen heater, heater power supply, temperature sensor, and controller to control the temperature of the heater.
Figure 2B:
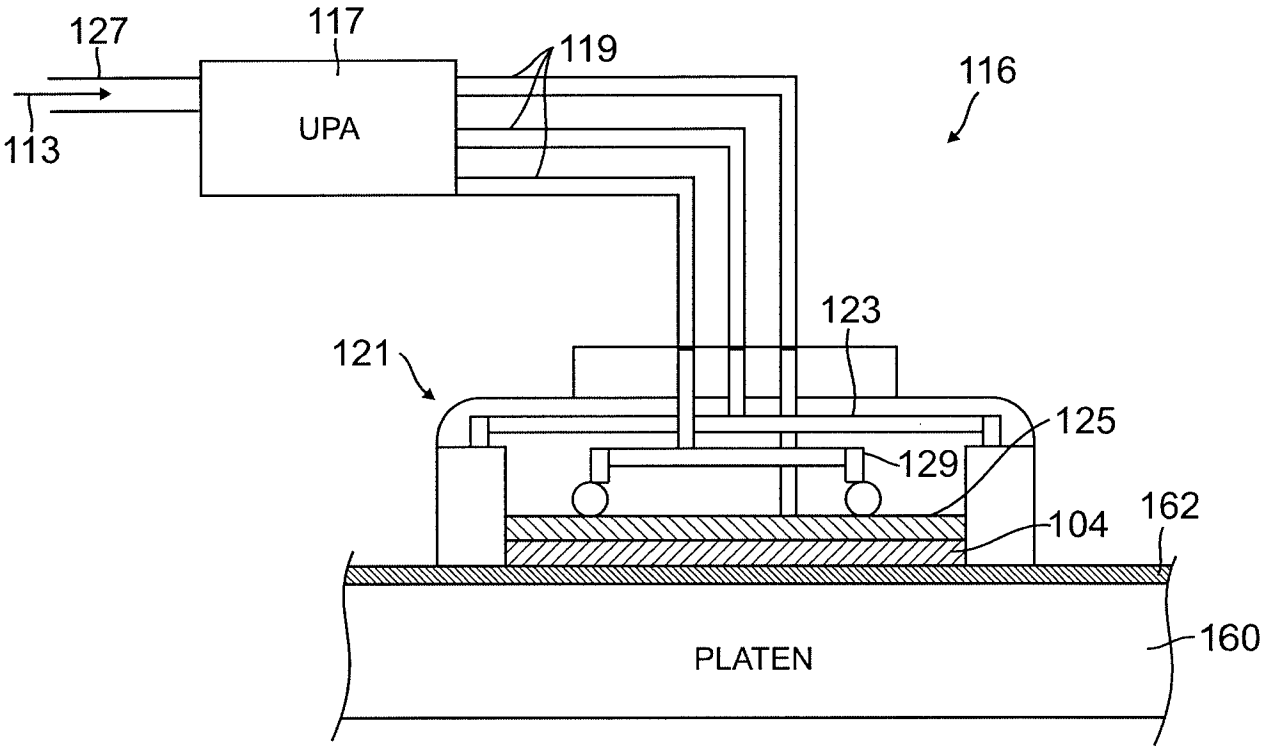
FIG. 2B is a schematic side view of a substrate carrier.

A schematic side view of a substrate carrier 116 is shown in FIG. 2B. The substrate carrier 116 comprises an upper pneumatic assembly 117 (UPA), conduits 119 and CMP head 121. The UPA 117 is connected to the CMP head 121 by the conduits 119. The CMP head 121 comprises retaining ring 123 to retain a substrate 104 and membrane 125 to apply a pressure to the backside surface of the substrate 104, to press the substrate 104 against the platen 160 during polishing. Air 113 is provided into the UPA 117 by way of a conduit 127 and the UPA controls the pressure of air in the conduits 119 to control downward forces applied to membrane 125, retaining ring 123 and inner tube 129 of the CMP head.

A polisher station 124 capable of polishing a substrate 104, which is held by a substrate carrier 116, comprises a polishing platen 160 that supports a polishing pad 162 as shown in FIG. 2A. The substrate carrier 116 presses and oscillates a substrate 104 against the polishing pad 162. The platen 160 can be an aluminum or stainless steel plate with a flat surface. Optionally, a platen motor (not shown) can be coupled to the underside of the platen 160 to oscillate or vibrate the platen 160.

The polishing pad 162 comprises a conventional pad material which is generally a polymer with or without added abrasive particles, for example, polymeric materials currently used by pad manufacturers such as Rodel Inc., of Newark, Del. The polishing surface of the polishing pad 162 can comprise a web of interwoven strips of abrasive separated by grooves, and adhered to a base film (not shown). In one version, the polishing pad 162 comprises a polymeric material with a hardness in a range of about 20-80 on the Shore D scale, and an average surface roughness of from about 0.5 to about 100 microns measured over a length scale of about 400 to about 1500 microns. The polymeric material is mounted on a base film such as, for example, a plastic material, such as a Mylar® film having a thickness of from about 50 to 500 microns.

During the polishing process, a pad conditioner 180*a-c* can also be used to condition the polishing pad 162. Each pad conditioner 180*a-c* includes a conditioner head 182, an arm 184, and a base 186. The arm 184 has a distal end coupled to the conditioner head 182 and a basal end coupled to the base 186. The arm 184 sweeps the conditioner head 182 across the polishing pad 162 so that an abrasive face of the conditioner head 182 can condition the polishing pad 162 by abrading the polishing surface to remove contaminants and re-texturize the polishing pad 162 surface. Each polisher station 124 can also includes cups (not shown), which contain a cleaning liquid for rinsing or cleaning the pad conditioner 180*a-c*.

A polishing medium dispenser 290 is provided to dispense polishing medium onto the polishing pad 162. The polishing medium can be a polishing liquid containing chemicals that assists in the chemical component of the polishing process, polishing slurry containing abrasive particles, water or another lubricating solvent, or any combination thereof. The polishing medium dispenser 290 can also apply a neutralizing solution to neutralize the chemical action of the polishing liquid or slurry. The polishing medium dispenser 290 can further apply a rinsing fluid to the polishing pad 162. The rinsing fluid can be, for example, water or de-ionized water and can be sprayed onto the polishing pad 162 at high pressure to rinse away polishing medium and contaminants from the polishing surface. The controller 130 controls a polishing medium supply 294, which can also include a rinsing fluid supply 270, to control the amount of polishing medium or rinsing fluid supplied to the platen 160. The polishing medium dispenser 290 is typically mounted adjacent to the polishing platen 160 and comprises a dispenser arm with one or more nozzles capable of supplying polishing medium to the platen.

A polisher station 124 comprises a platen 160 that supports a polishing pad 162. The platen 160 has an upper portion 190 that contains a center recess 192, and a plurality of passages 194 disposed adjacent to the recess 192. The recess 192 and passages 194 are coupled to a fluid source (not shown). Fluid flowing through the passages 194 may be used to control the temperature of the platen 160, polishing pad 162, and substrate 104. The top surface 196 of the platen 160 comprises a sub-pad 197 and sub-plate 198 disposed in a center recess 192. The sub-pad 197 is typically made from a polymeric material, such as polycarbonate or foamed polyurethane, in a hardness selected to produce a particular polishing result. The sub-pad 197 also maintains the polishing pad 162 parallel to the plane of the substrate 104 held in the carrier head 116 to promote global planarization of the substrate 104. Both the sub-pad 197 and the sub-plate 198 optionally contain a plurality of apertures (not shown) that are generally disposed in a pattern such that the polishing motion of the substrate 104 does not cause a discrete portion of the substrate to pass repeatedly over the apertures while polishing as compared to the other portions of the substrate 104. A port 202 is provided in the center recess 192 and is coupled to an external pump 206. When a vacuum is drawn through the port 202, air between the polishing pad 162 and the sub-pad 197 is removed to firmly secure the polishing pad 162 to the sub-pad 197 during polishing. An example of a polishing pad retention system is disclosed in U.S. patent application Ser. No. 09/258,036, filed Feb. 25, 1999, by Sommer et al. The reader should note that other types of devices might be utilized to adhere the polishing pad 162 to the platen 160, for example, adhesives, bonding, electrostatic chucks, mechanical clamps and other retention mechanisms.

A blast of gas, such as air, may be provided through the port 202 into the recess 192 by the pump 206, to assist in releasing the polishing pad 162 from the sub-pad 197 prior to advancing the polishing pad 162. The air blast also counteracts any surface tension forces caused by fluid that may be disposed between the sub-pad 197 and the polishing pad 162. The air pressure within the recess 192 moves through the apertures 205 in the sub-pad 197 and sub-plate 280 to lift the polishing pad 162 from the sub-pad 197 and the top surface 260 of the platen 160. The polishing pad 162 rides upon the cushion of air such that it may be freely indexed across the platen 160. Alternatively, the sub-pad 197 may be a porous material that permits gas (e.g., air) to permeate therethrough and lift the polishing pad 162 from the platen 160. Such a method for releasing the pad 162 is described in U.S. patent application Ser. No. 09/676,395, filed Sep. 29, 2000, by Butterfield, et al.

A roller pad assembly 200 that stretches and advances a polishing pad 162 comprising a roller pad, across the platen 160, is shown in FIG. 2A. Typically, the polishing pad 162 is releasably fixed by adhesives, vacuum, mechanical clamps or by other holding methods to the platen 160. The roller pad assembly 200 comprises a roller supply assembly 204 to supply polishing pad 162, and a roller take-up assembly 208 that takes-up spent polishing pad 162. The polishing pad 162 is provided by a roller pad roll 210 which is mounted on the roller supply assembly 104. The roller supply assembly 204 has an upper guide member 212 and a lower guide member 214 disposed between the roller enclosure 216. The lower guide member 214 is positioned to lead the polishing pad 162 from the roller pad roll 210 to the upper guide member 212. The upper guide member 212 is disposed such that the polishing pad 162 leading off the upper guide member 212 is disposed adjacent to the platen 160.

Generally, the roller take-up assembly 208 includes the take-up roll 218, an upper guide member 220 and a lower guide member 222 that are all disposed within the enclosure 216. The take-up roll 218 generally contains a used portion of polishing pad 162 and is configured so that it may easily be replaced with an empty take-up roll once it is filled with spent polishing pad 162. The upper guide member 220 is positioned to lead the polishing pad 162 from the platen 160 to the lower guide member 222. The lower guide member 222 leads the polishing pad 162 onto the take-up roll 218. The polisher station 124 may also comprise an optical sensor 224, such as a laser, adapted to transmit and receive optical signals for detecting an endpoint to the polishing process performed on a substrate 104.

The polishing pad 162 is advanced across the platen 160 by at least one roller motor 226*a,b* which is coupled to the roller supply and take-up assemblies 206, 208, respectively. The roller motors 226*a,b* incrementally advance the polishing pad 162 to add a span comprising a length of unworn polishing pad 162 to the surface being used to polish a substrate 104. Separate roller motors 126*a,b* can also be used to controllably rotate the roller supply assembly 204 and the take-up assembly 208, respectively. An example of an advanceable roller pad assembly 200 is disclosed in U.S. Pat. No. 6,503,131, issued Jan. 7, 2003, entitled "Integrated Polisher station for a Chemical Mechanical Planarization System". Alternative roller motors and other optional drive systems, such as for example, those described in U.S. Pat. No. 6,244,935, issued Jun. 12, 2001, entitled "Apparatus and Methods for Chemical Mechanical Polishing with an Advanceable Polishing Sheet", which is incorporated by reference herein and in its entirety, and others that will be apparent to those of ordinary skill in the art are included in the scope of the present invention. The roller pad roll 210 comprises a rolled up sheet of polishing pad 162, and is adapted to be easily replaced with another roll 210 containing a new polishing pad 162 material when the current pad is consumed. The roll 210 can be, for example, a replaceable roller pad roll as disclosed in aforementioned U.S. Pat. No. 6,244,935.

Before, after or during polishing of a substrate 104, the polishing pad 162 is advanced by a span comprising a length of the pad. The span of the polishing pad which is advanced, can be a predetermined length or continuously variable length. The advancing span length can depend, for example, upon the number of substrates 104 that were polished, the wear rate and clogging rate of the surface of the polishing pad 162, and the abrasive or chemical etching properties of the polishing medium. Typically, the wear rate of the polishing pad 162 is proportional to the amount and hardness of substrate material removed in a polishing step, and the difference in hardness between the polishing pad 162 and substrate 104. However, other factors can also affect the wear rate of the polishing pad 162.

As the polishing pad 162 is worn and advanced, a heater 240 heats the substrate 104, directly or indirectly, to a temperature sufficiently high to provide a rate of removal of material from the substrate that compensates for the wear of the polishing pad. For example, the heater 240 can heat the pad 162 to maintain a predetermined polishing rate, which is the rate of removal of material from a substrate 104, that compensates for the wear of the polishing pad 162 over time. As one example, the substrate polishing rate can be between about 100 and about 10,000 Å/min or even about 1000 Å/min. Heating the substrate 104 increases the reaction rate at the substrate surface to provide faster chemical mechanical polishing rates. The faster polishing rate compensates for the gradual reduction in polishing rate obtained as a polishing pad 162 wears out or becomes clogged with polishing debris. Conversely, reducing the heat applied to the substrate 104 reduces the rate of polishing of the substrate 104. Thus, the amount of heat applied to the substrate 104 can be used to control the reaction rate at the substrate surface, and this in turn, can be used to adjust the substrate polishing rate to compensate for the reduced polishing efficiency provided by the polishing pad 162 over time. It should be understood that the substrate 104 can be heated by heating the substrate directly, or by heating the substrate indirectly by heating the platen, polishing medium, or other components, liquids and fluids used in the polishing process.

In one embodiment, the controller 130 comprises program code to control the roller motors 126*a,b* of the roller pad assembly to set the span of the polishing pad 162 which is advanced before, after or during polishing of a substrate 104. While causing advancing of the pad 162 by the preset span length, the controller also comprises heater program code to control the power applied to the heater 240 to maintain the substrate 104 at a temperature sufficiently high to provide a difference in polishing rates from a first substrate to a last substrate of a batch of substrates 104 that is less than 20%. For example, the first to last of the substrates 104 can be all the substrates from a batch of about 25 substrates, or even 100 or more substrates. As one example, a batch of substrates can be sized from about 25 to about 500 substrates. The difference in polishing rates between the first and last substrates 104 of the batch can even be maintained at less than 20% using this method. In one version, the heater 240 heats the platen 160 to a temperature of at least about 30° C., or even from about 30 to about 60° C. The heat applied to the substrate 104 can be increased over time, or maintained at the same amount, depending on the number of substrates 104 being processed and wear rate of the polishing pad 162 for each polished substrate 104.

In another version, the heater 240 heats the substrate 104 to a temperature sufficiently high to maintain a polishing rate, or rate of removal of material, from a first substrate 104 to a last substrate 104 of a batch of 10 substrates 104 that is less than 20%, while also reducing the advancing rate of the polishing pad 162 to less than 3 mm/substrate. Typically, the polishing pad 162 is advanced by a span comprising a length after polishing a single substrate 104, or after polishing a number of substrates from a batch of substrates. A reduction in the advancing rate of the polishing pad 162 provides significant cost benefits, and also allows processing of a larger number of substrates 104 with a single roll of polishing pad 162.

The controller 130 comprises program code to control the heater 240 by controlling the heater power supply 242 to achieve the desired temperature of the heater 240 or substrate 104. The controller 130 comprises program code to control the heater power supply 242 set and maintain a temperature of the heater 240, gradually increase the temperature of the heater 240 over time, or even reduce the temperature of the heater 240. The heater 240 can also be operated by the controller 130 in relation to a signal from a sensor (not shown) which is received by the program code of the controller. The sensor signal can determine a wear rate of the polishing pad 162, sequential polishing rates of sequentially polished substrates 104, or even the instantaneous polishing rate of a particular substrate 104.

The heater 240, which is used to heat the substrate 104 directly or indirectly, can be any one of a number of different heaters or even a combination of different heaters. While particular versions of heaters are described herein to illustrate the invention, it should be understood that alternative heating systems and heater structures as would be apparent to those of ordinary skill in the art can also be used. Thus the scope of the present claims should not be limited to the versions of the heaters described herein.

In one version, as shown in FIG. 2A, the heater 240 for heating the substrate 104 comprises a platen heater 244 for heating the platen, and thus, indirectly heating the substrate 104. In one version, the platen heater 240 comprises a plurality of lamps 246*a,b* which are positioned under and behind the platen 160. For example, the lamps 246*a,b* can be incandescent or infrared heater lamps. The lamps 246*a,b* direct radiation to the back of the platen 160 to heat the platen. A heater power supply 242 is used to control the electrical power applied to the lamps 246*a,b*. The controller 130 comprises program code to control the power supply 242 to set the power applied to the lamps 146*a,b* to control the platen temperature, and consequently, the substrate temperature. A temperature sensor 248, such as a thermocouple, infrared sensor, or other temperature sensor, can be mounted to contact, or be positioned adjacent to, the back surface of the pad 162 to measure the temperature of the platen 160, pad 126, and from that temperature measurement, estimate the temperature of the substrate 104. The platen heater 244 can also be a resistor 250 embedded in the platen as shown in FIG. 4.

Figure 3:
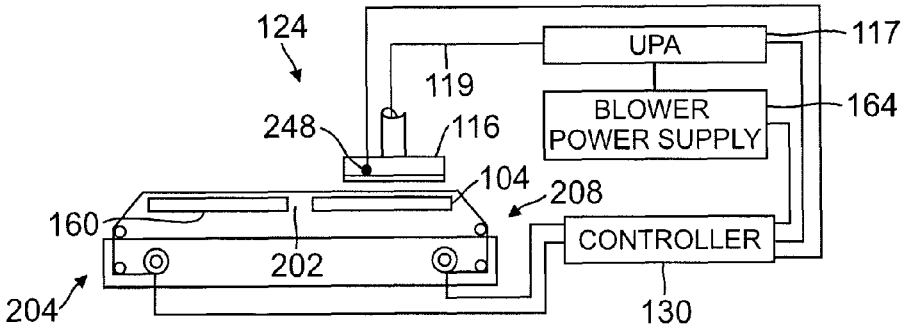
FIG. 3 is a schematic side view of a polisher station with an upper pneumatic assembly system comprising a hot air blower that heats the platen by directing hot air towards the substrate.

In yet another version, the heater 240 comprises a hot gas source that heats the platen 160 indirectly by blowing hot gas at the backside surface of the substrate 104, as shown in FIG. 3. The UPA comprises a hot gas blower that is driven by a blower power supply 164. The blower power supply 164 can be used to control the electrical power applied to the hot gas blower to set the temperature of the hot gas, which can be air, and in turn, control the temperature of the substrate 104 and platen 160. A temperature sensor 248 can be used to directly measure the temperature of the substrate 104, platen 160, or to measure the temperature of the hot gas, to estimate the temperature of the platen 160.

Figure 4:
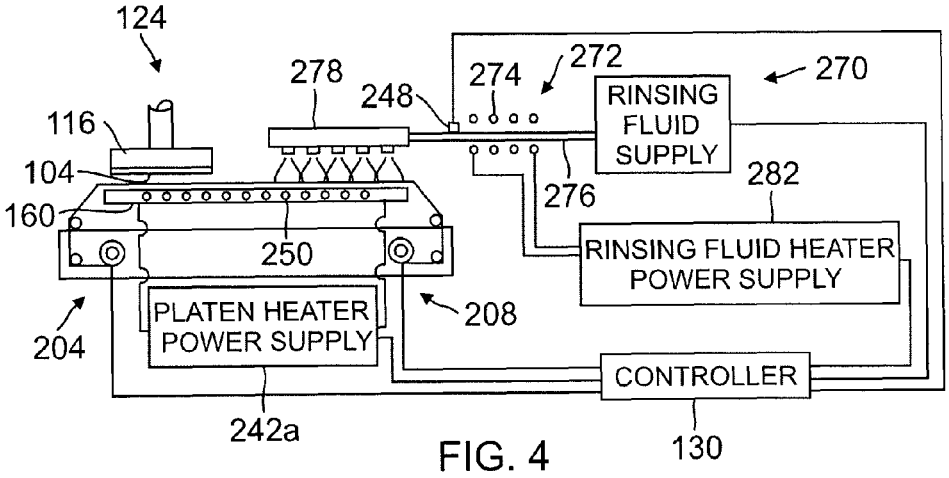
FIG. 4 is a schematic side view of a polisher station comprising a polishing platen with a built-in platen heater and heated rinsing system.

In still another version, a rinsing system 270 provides a rinsing fluid to rinse the platen 160 after polishing the substrates 104, and in this version, the heater 240 can comprise a rinsing fluid heater 272 to heat the rinsing fluid, as shown in FIG. 4. Although the rinsing system 270 is shown as an independent fluid dispenser system in FIG. 4, the rinsing system 270 can alternately be integrated into the polishing medium dispenser 290, as shown for example in FIG. 2. The rinsing fluid is applied to the polishing pad and/or platen 160 before or after polishing to rinse off residue from the surface of the platen 160, and in this step, the heated rinsing fluid heats the platen 160, and thus, heats a substrate 104 which is subsequently placed in contact with the polishing pad on the platen 160. The rinsing fluid can be, for example, distilled or filtered water. The rinsing fluid heater 272 can be a resistor coil 274 that is wound around a tube 276 that supplies the rinsing fluid to a fluid dispenser 278 which sprays the fluid through nozzles 280 onto the pad 162.

A rinsing fluid heater power supply 282 can be used to control the electrical power applied to the rinsing fluid heater 240 to set the temperature of the rinsing fluid flowing through the tube. The controller 130 comprises program code to control the power supply 282 to set the temperature of the rinsing fluid, and consequently, the temperature of the platen 160 and substrate 104. A temperature sensor 248 can be used to measure the temperature of the rinsing fluid. When the rinsing fluid is used to rinse off a platen 160 between polishing of substrates, heating the rinsing fluid maintains a temperature of the platen between polishing of different substrates 104. This allows successive substrates 104 to be polished more efficiently and at higher polishing rates than if cold rinsing fluid was used to clean off the platen 160. In the version shown, the heater 240 comprises both a built-in platen heater 244 with a platen heater power supply 242*a* and heated rinsing system 270; however, one or the other can be used. This version provides both the benefits of heating the rinsing fluid to prevent a drop in temperature of the platen 160 between the processing of one substrate 104 and another, as well as enabling the platen to rapidly heat the surface of new substrate 104 to the desired temperature.

Figure 5:
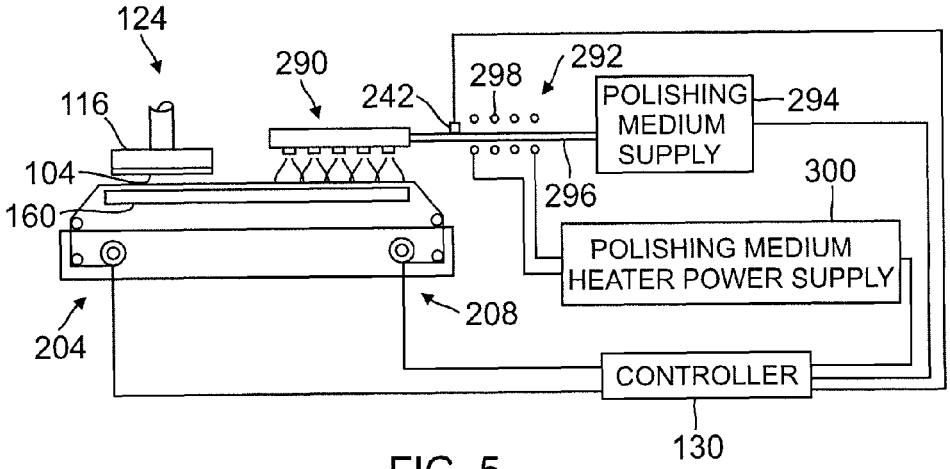
FIG. 5 is a schematic side view of a polisher station showing a polishing platen and a heated polishing medium dispenser.

In another embodiment, the heater 240 comprises a polishing medium heater 292 to heat the polishing medium, as shown in FIG. 5. The polishing medium is supplied from a polishing medium supply 294 which feeds tube 296. A heater coil 298 is wrapped around a tube 296 to heat the polishing fluid passing through the tube. The controller comprises program code to control a polishing medium heater power supply 300 which provides the electrical power applied to the polishing medium heater 292 to set the temperature of the polishing medium, and consequently, control the temperature of the platen 160 and substrate 104. A temperature sensor 242 can be used to directly measure the temperature of the platen 160, substrate 104, or to measure the temperature of the polishing medium, to estimate the temperature of the platen 160 and substrate 104.

The temperature controllable heater 240 of the polisher 100 compensates for the gradual wear of the polishing pad 162 to provide more uniform and consistent polishing rates from one substrate 104 to another substrate in a batch of substrates 104. This provides predictability in polishing time, and consequently batch processing time, which enables better process scheduling. In a semiconductor wafer fabrication lab, consistent scheduling improves the overall process efficiency, as each substrate 104 can be subjected to many sequential processes. In addition, heating the substrate 104 or platen 160 allows a reduction in the advance rate of the polishing pad 162 to reduce costs associated with replacing the polishing pad 162.

A embodiment of a controller 130 suitable for operating the chemical mechanical polisher 100 comprises a central processing unit (CPU) 132 memory 134, hardware circuits 136, and input/output interface circuits 138. The CPU 110 is a computer processor such as a Pentium-4® type processor from Intel Corp., Santa Clara, Calif. The memory 134 comprises computer-readable medium, such as random access memory (RAM), read only memory (ROM), a floppy or hard disk, or any other form of digital storage, local or remote. The hardware circuits 136 are coupled to the CPU 110 and can include cache, power supplies, clock circuits, input/output circuitry, and other subsystems. The input/output interface circuits 138 include serial and parallel busses for communications. A display 140 and an input devices 142, such as a mouse and/or keyboard, provides an interface for the operator of the controller 130.

A computer program that resides in, or is retrieved by, the controller 130 is written in any conventional computer readable programming language such as for example native code, assembly language, C, C++, or Pascal. The computer program comprises program code which is entered as a single file, or multiple files, using a conventional text editor, and stored or embodied in a computer usable medium, such as a memory system of the computer. Code text in high level languages is compiled and the resultant compiler code is then linked with an object code of precompiled library routines. To execute the linked compiled object code, the system user invokes the object code, causing the computer system to load the code in memory, from which the CPU 134 reads and executes the code to perform the tasks identified in the program. The computer program is a computer-readable programs such as those which can be stored on other memory.

The computer program generally comprises polishing station program code comprising instruction sets that operate each polishing station 124*a-d*. For example, the polishing station program code can include a roller pad assembly program code comprising instruction sets to control the roller pad assembly 200, which includes the rotor motors 226, to set the timing and advancing span length of the polishing pad 162. This program code can determine the span of the polishing pad to be advanced and can advance the pad 162 in stepwise manner by predetermined lengths or continuously. The program code can also set the advancing span length in response to, for example, the type or number of substrates 104 that are polished, the properties of the polishing pad 162 and empirically determined wear and clogging rates of the polishing pad 162 over time, and the amount or type of polishing medium being used.

The computer program also comprises heater control program code that includes heater control instruction sets to control the heater power supply 242 associated with each heater 240 to supply power to the one or more heaters 240 that can be included in the system. For example, the heater control program code can include instructions to apply sufficient power to the heater 240 to heat the substrate 104 to a temperature sufficiently high to provide a rate of removal of material from the substrate that compensates for the wear of the polishing pad over time.

The program code can also contain algorithms that are modeled from empirically determined data; tables of empirically determined or calculated values that may be used to monitor the process; and properties of the materials being polished on the substrates 104. These algorithms can be used to control movement of the polishing pad 162 and the temperature of the heater 240 in relation to the measured or predetermined wear rate of the polishing pad 162, the rate of advance of polishing pad, and the variation in polishing rates of the substrates 104 of a batch of substrates.

The present invention has been described with reference to certain preferred versions thereof; however, other versions are possible. For example, other types of polishing pads 162, such as disc or even square pads can be used, as would be apparent to one of ordinary skill in the art. The CMP polisher 100 described herein can also have other configurations and adaptations. Therefore, the spirit and scope of the appended claims should not be limited to the description of the preferred versions contained herein.

What is claimed is:

1. A chemical mechanical apparatus comprising:

(a) a polishing platen;

(b) a roller pad assembly capable of advancing a polishing pad across the platen;

(c) a substrate carrier to press a substrate against the polishing pad;

(d) a heater to heat the substrate and (e) a controller comprising program code to control the power applied to the heater to adjust the temperature of the substrate to maintain each substrate from a batch of substrates at a temperature that is sufficiently high to provide a rate of removal of material from the substrate that compensates for the wear of the polishing pad such that the variation in polishing rate from one substrate to another in the batch of substrates is less than 20%.

2. An apparatus according to claim 1 wherein the roller pad assembly comprises a roller motor, and wherein the controller comprises program code to control the roller motor to advance the polishing pad by a span, before, after or during polishing of a substrate.

3. An apparatus according to claim 2 wherein the controller comprises program code to control the roller motor to advance the polishing pad by a span having a length of less than 3 mm, while controlling the power applied to the heater to heat the platen to a temperature of at least about 30° C.

4. An apparatus according to claim 2 wherein the controller comprises program code to control the power applied to the heater to heat the platen to a temperature of less than about 60° C.

5. An apparatus according to claim 1 comprising a polishing medium dispenser to dispense polishing medium onto the substrate, and wherein the heater comprises a polishing medium heater.

6. An apparatus according to claim 1 wherein the heater comprises a platen heater.

7. An apparatus according to claim 1 wherein the heater comprises a hot gas blower that blows gas on the platen.

8. An apparatus according to claim 1 comprising a rinsing system to provide fluid to rinse the platen after polishing one or more substrates, and a rinsing fluid heater to heat the rinsing fluid.

9. A chemical mechanical apparatus comprising:

(a) a polishing platen;

(b) a roller pad assembly capable of advancing a polishing pad across the platen, the roller pad assembly comprising at least one roller motor;

(c) a substrate carrier to press a substrate against the polishing pad;

(d) a heater to heat the platen and polishing medium; and (e) a controller comprising:

(i) program code to control the roller motor to advance the polishing pad by a span, before, after or during polishing of a substrate, and (ii) program code to control the power applied to the heater to maintain the substrate at a temperature sufficiently high to obtain a difference in polishing rates from a first substrate to a last substrate of a batch of substrates, that is less than 20%.

10. An apparatus according to claim 9 wherein the controller comprises program code to control the roller motor to advance the polishing pad by a span having a length of less than 3 mm.

11. An apparatus according to claim 9 wherein the controller comprises program code to control the power applied to the heater to maintain the platen at a temperature of less than about 60° C.

12. A chemical mechanical apparatus comprising:

(a) a polishing platen;

(b) a roller pad assembly capable of advancing a polishing pad across the platen, the roller pad assembly comprising at least one roller motor;

(c) a substrate carrier to press a substrate against the polishing pad, the substrate obtained from a batch of substrates;

(d) a heater to heat the platen and polishing medium; and (e) a controller comprising:

(i) program code to control the roller motor to advance the polishing pad by a span having a length of less than 3 mm, before, after or during polishing of each substrate from the batch of substrates; and (ii) program code to control the heater to heat the substrate to a temperature sufficiently high to maintain a polishing rate for each substrate from the batch of substrates that is at least about 1000 Å/min.

13. An apparatus according to claim 9 comprising a polishing medium dispenser to dispense the polishing medium onto the substrate, and wherein the heater comprises a polishing medium heater.

14. An apparatus according to claim 9 wherein the heater comprises a platen heater or hot gas blower.

15. An apparatus according to claim 9 comprising a rinsing system to provide fluid to rinse the platen after polishing one or more substrates, and a rinsing fluid heater to heat the rinsing fluid.

16. An apparatus according to claim 12 comprising a polishing medium dispenser to dispense the polishing medium onto the substrate, and wherein the heater comprises a polishing medium heater.

17. An apparatus according to claim 12 wherein the heater comprises a platen heater or hot gas blower.

18. An apparatus according to claim 12 comprising a rinsing system to provide fluid to rinse the platen after polishing one or more substrates, and a rinsing fluid heater to heat the rinsing fluid.

* * * * *